US009603386B2

(12) United States Patent
Xiang

(10) Patent No.: US 9,603,386 B2
(45) Date of Patent: Mar. 28, 2017

(54) METHOD AND DEVICE FOR HEATING CONTROL OF AN ELECTRONIC CIGARETTE

(71) Applicant: Zhiyong Xiang, Shenzhen (CN)

(72) Inventor: Zhiyong Xiang, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 516 days.

(21) Appl. No.: 13/870,797

(22) Filed: Apr. 25, 2013

(65) Prior Publication Data

US 2014/0251324 A1 Sep. 11, 2014

(30) Foreign Application Priority Data

Mar. 5, 2013 (CN) ..... 2013 1 0069686

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

2009/0126745 A1* 5/2009 Hon ..... 131/273
2012/0199146 A1* 8/2012 Marangos ..... 131/328
2013/0340750 A1* 12/2013 Thorens et al. ..... 128/202.21
2014/0020693 A1* 1/2014 Cochand ..... A61M 11/041 131/273

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

A method and device for heating control of an electronic cigarette are provided, wherein, the method includes steps as below: S1. sensing whether there is a smoke signal via a sensor or a switch, if yes, executing step S2; S2. activating a timer to record time and turn on a semiconductor switch so as to heat the heating element in a full output power mode; S3. heating the heating element in a constant power mode when the recording time of the timer arrives at a first preset time T0. When implementing the present invention, the adoption of the two heating methods for heating element makes an optimized atomization effect and an excellent taste of smoking possible, which is not affected by the changeable voltage of the battery.

2 Claims, 3 Drawing Sheets

METHOD AND DEVICE FOR HEATING CONTROL OF AN ELECTRONIC CIGARETTE

CROSS-REFERENCE TO RELATED APPLICATIONS

This non-provisional application claims priority under 35 U.S.C. §119(a) on Patent Application No. 201310069686.5 filed in P.R. China on Mar. 5, 2013, the entire contents of which are hereby incorporated by reference.

FIELD OF THE INVENTION

The present invention relates to the field of electrical heating product, and more particularly relates to a method and device for heating control of an electronic cigarette.

BACKGROUND OF THE INVENTION

Electronic cigarette serves as a substitution of cigarette for smokers in the form of atomized tobacco juice via heating, and it is becoming more and more popular among smokers at present. Electronic cigarette is composed of multiple components including battery, control circuit and heating element. There are two heating methods for electronic cigarette in the prior art, one is a full voltage output heating method, the other is a constant voltage output heating method. The drawbacks of above-mentioned heating methods are as follows: the heating effect of the former one is affected by the voltage of the battery, and the taste of atomized smog of the latter one is steady since its heating mode is stable, as a result, the simulated taste and feeling provided by electronic cigarette under constant voltage output heating mode are not as good as the taste and the feeling provided by a real cigarette.

SUMMARY OF THE INVENTION

The object of the present invention is to provide a method and a device for heating control of an electronic cigarette which can control to vary the heating methods through a microcontroller, aiming at the aforementioned drawbacks in the prior art including changeless heating method and steady taste of atomized smog for electronic cigarette.

The technical solutions adopted to solve the technical problem are as follows: a method for heating control of an electronic cigarette is provided, which comprises steps as follows:

S1. sensing whether there is a smoke signal via a sensor or a switch, if yes, executing step S2;

S2. activating a timer to record time and turn on a semiconductor switch so as to heat the heating element in a full output power mode;

S3. heating the heating element in a constant power mode when the recording time of the timer arrives at a first preset time T0.

In the method for heating control of an electronic cigarette of the present invention, the step S3 further comprises:

S31. sampling the voltage of a power battery;

S32. calculating the duty ratio of the pulse width modulation signal in accordance with the voltage of the power battery and the preset constant power;

S33. controlling the breakover of the semiconductor switch based on the calculated pulse width modulation signal, and implementing heating control of the heating element in the constant power mode.

In the method for heating control of an electronic cigarette of the present invention, it further comprises the following step after the step S3:

S4. resetting the count value of the timer.

In the method for heating control of an electronic cigarette of the present invention, it further comprises the following step before the step S1:

S0. setting the first preset time T0 and the preset constant power.

In the method for heating control of an electronic cigarette of the present invention, the semiconductor switch is one of a triode, a field-effect tube, and an insulated gate bipolar transistor.

A device for heating control of an electronic cigarette is also provided, it comprises a heating element, a power battery used for powering the electronic cigarette, a semiconductor switch used for controlling the power battery to heat the heating element or not, a smoke signal detecting module used for detecting whether there is a smoke signal and a microcontroller connected with the power battery, the smoke signal detecting module and the control end of the semiconductor switch simultaneously; the microcontroller further comprises a timer, the microcontroller will give orders to turn on the semiconductor switch and activate the timer to record time when a smoke signal has been detected by the smoke signal detecting module, the heating element is heated in a full power output mode; the heating element is heated in a constant power control mode when the count value of the timer arrives at a first preset time T0.

In the device for heating control of an electronic cigarette of the present invention, the microcontroller further comprises:

a sampling unit, which is used for sampling the voltage of the power battery;

a calculating unit, which is connected to the sampling unit and used for calculating the duty ratio of the pulse width modulation signal according to the voltage of the power battery and the preset constant power;

a control unit, which is connected to the calculating unit and used for controlling the breakover of the semiconductor switch based on the calculated pulse width modulation signal, and implementing heating control of the heating element.

In the device for heating control of an electronic cigarette of the present invention, the microcontroller further comprises:

a resetting unit, which is connected to the timer and used for resetting the count value of the timer.

In the device for heating control of an electronic cigarette of the present invention, it further comprises:

a setting module, which is connected to the microcontroller and used for setting the first preset time T0 and the preset constant power.

In the device for heating control of an electronic cigarette of the present invention, the semiconductor switch is one of a triode, a field-effect tube, and an insulated gate bipolar transistor.

When implementing the present invention, the following advantageous effects can be achieved: when a smoke signal is detected, the heating element is heated in a full output power mode firstly under the control of the microcontroller, and then, the heating element is heated in a constant power mode when the recording time of the timer arrives at the first preset time T0, which makes the temperature of the electronic cigarette ascending rapidly, and the tobacco tar of the heating element atomized rapidly, in the followed heating process, the heating element is heated in the constant power mode, which guarantees the heating effect, the atomization effect and the taste of smoking even though the voltage of the power battery is changeable.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the objects, technical schemes and advantages more clearly, the present invention may be further described in detail with reference to the accompanying drawings and embodiments. It should be understood that the preferred embodiments described here are illustrated but not limited.

Figure 1:
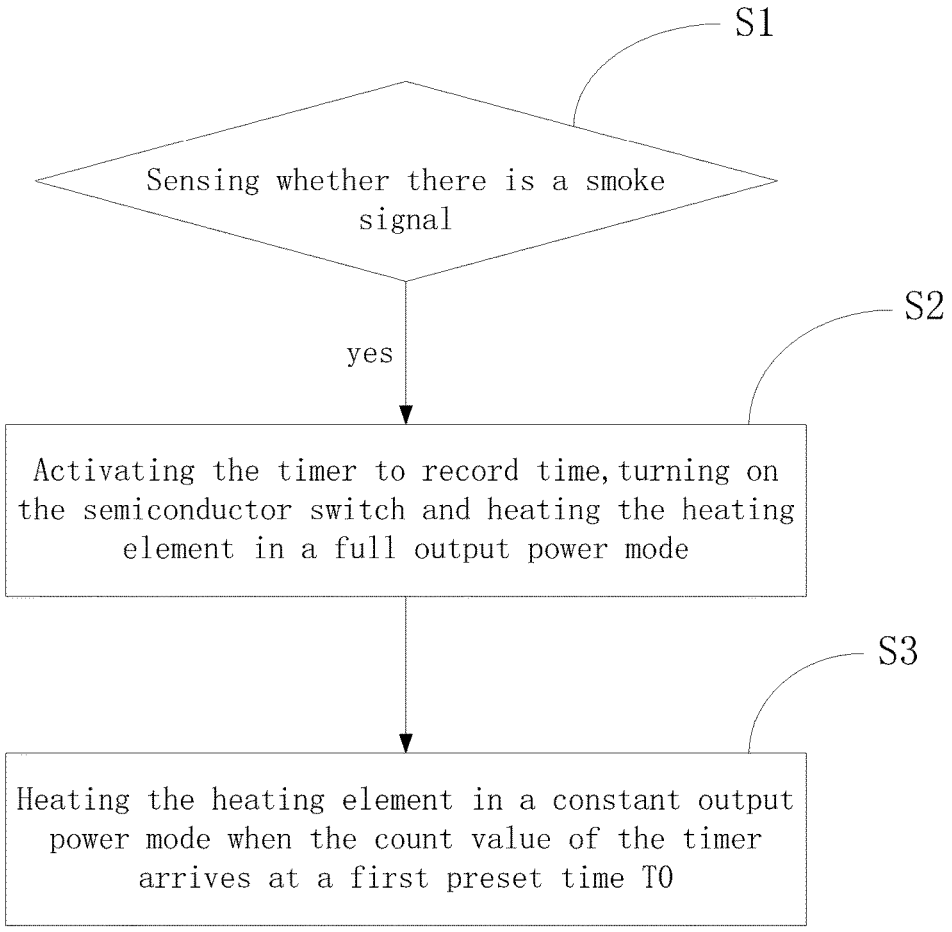
FIG. 1 is a flow chart of a method for heating control of an electronic cigarette in accordance with an embodiment of the present invention.

FIG. 1 has illustrated a flow chart of a method for heating control of an electronic cigarette in the present invention, wherein, the electronic cigarette is comprised of the components including a battery, a sensor or a button, a hearting element, a semiconductor switch and a microcontroller, the battery is used for power supply, the sensor or the button is used for the detection of the smoke signal, the semiconductor switch and the microcontroller are used for heating control of the heating element, as shown in FIG. 1, in one embodiment of the present invention, the method comprises following steps:

S1. sensing whether there is a smoke signal in the electronic cigarette via a sensor or a switch button, the existence of the smoke signal is demonstrated when the sensor has detected a signal or the switch button has been triggered, and then executing step S2; in step S1, the smoke signal may be generated by the sensor or the switch button via manual operation; in case that the smoke signal is generated by manual operation: setting a push button on the surface of the electronic cigarette and when the push button is pressed down, a smoke signal is sent out; in case that the smoke signal is generated automatically, smokers are able to change the barometric pressure of the airflow inside the electronic cigarette via sucking the suction nozzle, and a smoke signal is generated accordingly;

S2. activating the timer for recording time and turn on the semiconductor switch, so that the heating element is heated in a full output power mode; in the early stage of heating in step S2, heating the heating element through the voltage of the power battery as best as possible in the full output power mode, making heating element to atomize tobacco tar as soon as possible, according to which the waiting time of smokers is shortened;

S3. heating the heating element in a constant power mode when the count value of the timer is equal to the first preset time T0. In step S3, the heating element is heated in the constant power mode, which makes the tobacco tar to be atomized under the stable environment, the heating effect of the heating element is not affected even though the battery voltage changes, the atomization effect and the smoking taste for smokers are guaranteed to be good.

Figure 2:
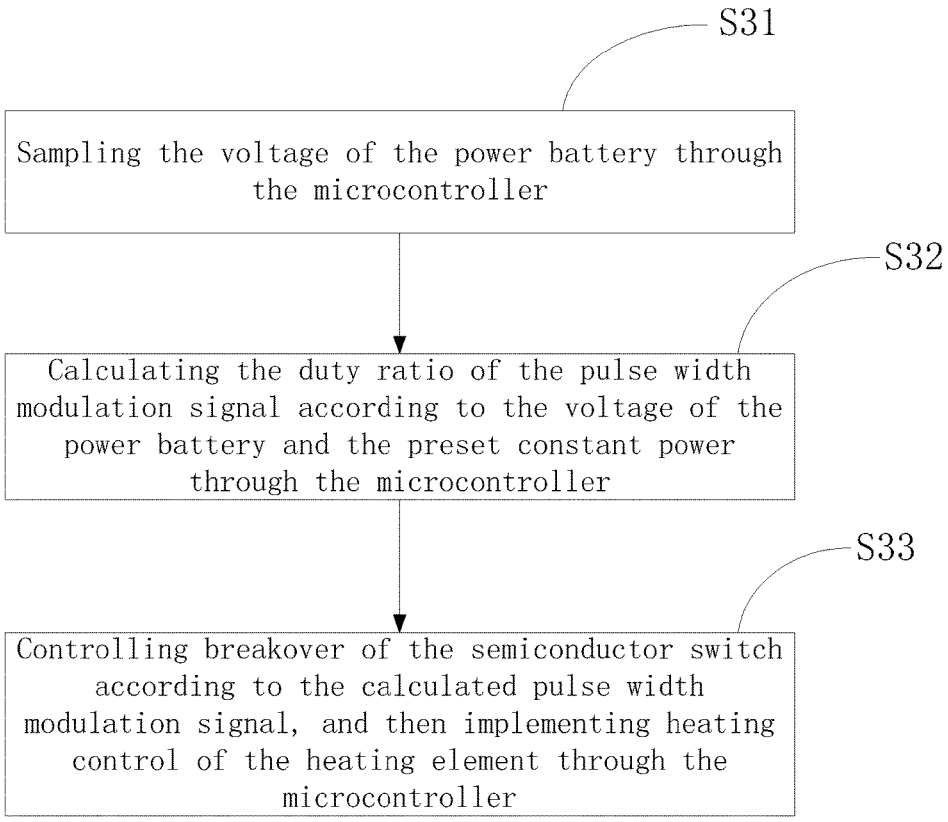
FIG. 2 is a detailed flowchart of the step S3 which is shown in FIG. 1.

Furthermore, the step S3 comprises detailed contents as follows (as shown in FIG. 2):

S31. sampling the voltage of the power battery; the power battery is affected by the time it has been used and the environmental condition, thus, the voltage provided by the battery is changeable;

S32. calculating the duty ratio of the pulse width modulation signal according to the voltage of the power battery and the preset constant power; a constant power P with the value of $U^2/R$ is set in the embodiment, that is, $P=U^2/R$, as battery voltage U is changeable, coefficient K is added into aforementioned equation to ensure that power P is constant, a new equation is concluded, that is, $P=U^2/R*K$, the duty ratio D of the pulse width modulation signal is adjusted according to the value of the coefficient K, that is, the value of the duty ratio D is corrected and equal to K. In actual application, the coefficient K can be 60%. The frequency of the pulse width modulation signal is adjustable, for example, the frequency can be 100 HZ. Different constant power values can be set for different electronic cigarettes to achieve different smoke effects.

S33. controlling the breakover of the semiconductor switch according to the calculated pulse width modulation signal, and then implementing heating control of the heating element in the constant power mode.

Furthermore, the step to be executed after step S3 is as follows:

S4. resetting the count value of the timer. The count value of the timer will be reset when the microcontroller is controlling to heat the heating element with a constant power.

Furthermore, the step followed by step S1 is as follows:

S0. setting the value of the first preset time T0 and the preset constant power. The first preset time T0 can be set to be one second, the first preset time T0 is set in accordance with the requirement of the smokers or the classification of tobacco tar in implementation, the tobacco tar is heated by the heating element and atomized as soon as possible. The value of the first constant power is set in accordance with the requirement of the smokers or the classification of tobacco tar, which makes a more humanized atomization effect and an improved user experience possible during tobacco tar atomization process. Different smoke effects can be obtained via setting different constant powers in accordance with the corresponding electronic cigarettes. The first preset time T0 is either a fixed value or a variable value which is adjusted according to the current voltage value of the power battery.

Furthermore, the semiconductor switch is one of a triode, a field-effect tube, and an insulated gate bipolar transistor.

Figure 3:
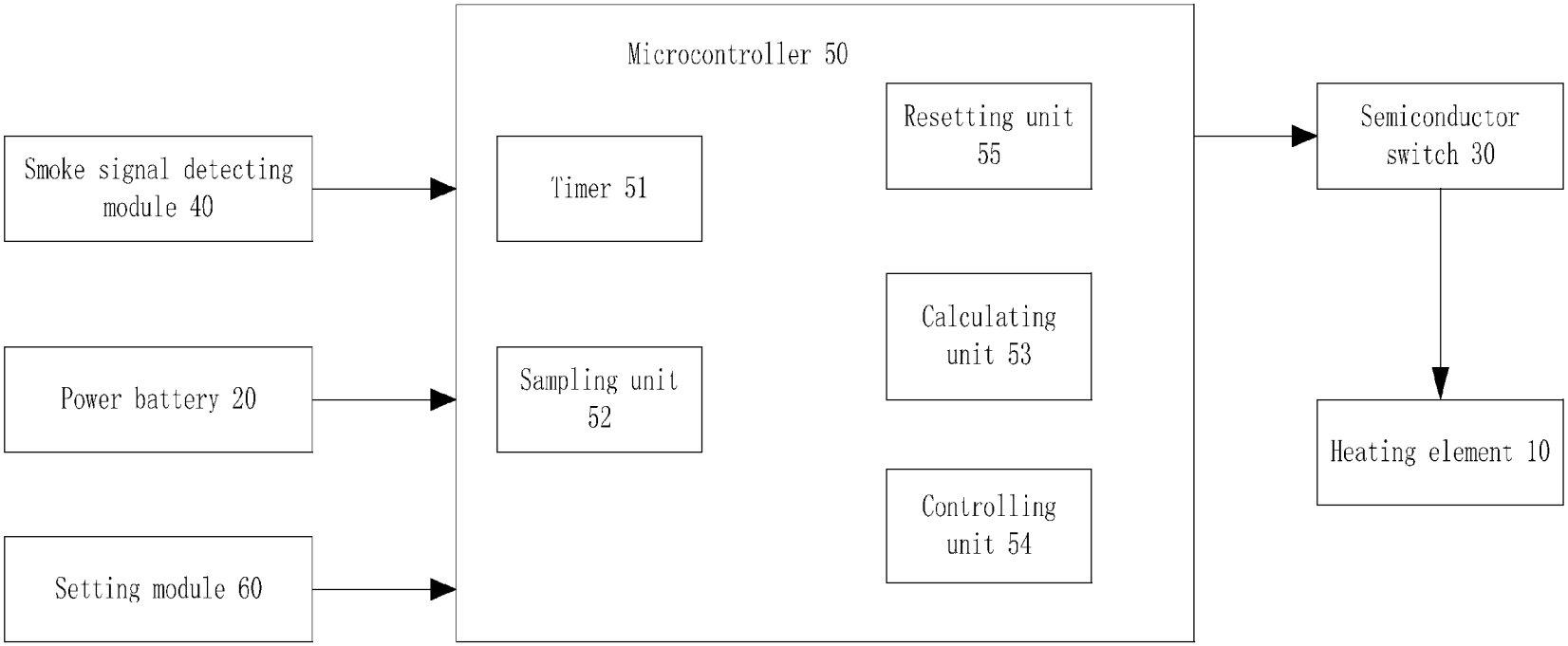
FIG. 3 a structure diagram of a device for heating control of an electronic cigarette in accordance with an embodiment of the present invention.

As shown in FIG. 3, the structure diagram of the device for heating control of an electronic cigarette in the present invention is illustrated, which comprises a heating element 10, a power battery 20, a semiconductor switch 30, a smoke signal detecting module 40 and a microcontroller 50, the power battery 20 is used for powering the electronic cigarette, the semiconductor switch 30 is used for controlling and judging to heat the heating element 10 or not, the smoke signal detecting module 40 is used for detecting the existence of the smoke signal, the microcontroller 50 is connected with the power battery 20, the smoke signal detecting module 40 and the control end of the semiconductor switch 30 respectively; the microcontroller 50 further comprises a timer 51, when the smoke signal is detected by the smoke signal detecting module 40, the semiconductor switch 30 receives an instruction from the microcontroller 50 and the switch will be turned on, the timer 51 receives the instruction from the microcontroller 50 and starts to record time, the heating element 10 is heated in the full power output mode; the heating element is heated in the constant power control mode when the count value of the timer 51 is equal to the first preset time T0. In the embodiment, the smoke signal may be generated automatically or manually; in case that the smoke signal is generated by manual operation: that is, when the push button installed on the surface of the electronic cigarette is pressed down, a smoke signal is sent out; in case of the automatical generation of the smoke signal, that is, smokers changes barometric pressure of the airflow inside electronic cigarette via sucking the suction nozzle, a smoke signal is generated accordingly. In the early stage of heating (within the first preset time T0), the microcontroller adopts the full output power mode to heat the heating element through the voltage of the power battery as best as possible, which makes the heating element to atomize the tobacco tar as soon as possible, the waiting time of smokers is shortened as well; the heating element is heated in the constant power mode when the count value of the timer is equal to the first preset time T0, which makes the tobacco tar to be atomized under stable environment, the heating effect of the heating element is not affected even though the voltage of the power battery changes, so that the atomization effect and the taste of smoking for smokers are guaranteed to be good.

Furthermore, the microcontroller 50 comprises the components as follows:

A sampling unit 52, which is used for sampling the voltage of the power battery; the power battery is affected by the time it has been used and the environmental condition, the voltage provided by the battery is changeable.

A calculating unit 53, which is used for calculating the duty ratio of the pulse width modulation signal according to the voltage of the power battery and the preset constant power; a constant power P with the value of $U^2/R$ is set in the embodiment, that is, $P=U^2/R$, as the voltage U of the power battery is changeable, the coefficient K is added into aforementioned equation to ensure that the power P is constant, a new equation can be concluded, that is, $P=U^2/R*K$, the duty ratio D of the pulse width modulation signal is adjusted according to the value of the coefficient K, that is, the value of duty ratio D is corrected and equal to K. In actual application, the coefficient K can be 60%. The frequency of the pulse width modulation signal is adjustable, for example, the frequency can be 100 HZ. Different constant power values can be set for different electronic cigarettes to achieve different smoke effects.

A controlling unit 54, which is connected to the calculating unit 53 and used for controlling the breakover of the semiconductor switch according to the calculated pulse width modulation signal and implementing heating control of the heating element in the constant power mode.

Furthermore, in another embodiment of the present invention, the microcontroller 50 further comprises a resetting unit 55 which is connected to the timer 51 and used for resetting the count value of the timer 51. The count value of the timer will be reset when the microcontroller controls to heat the heating element with the constant power.

Furthermore, in another embodiment of the present invention, the device for heating control further comprises a setting module 60, which is connected to the microcontroller 50 and used for setting the value of the first preset time T0 and the preset constant power. The first preset time T0 can be set to be one second or three second or the time bucket between one second and five second, the first preset time T0 is set according to the requirement of the smokers or the classification of the tobacco tar in application, the tobacco tar is heated by the heating element and atomized as soon as possible. The first constant power, which has been accurately controlled via the pulse width modulation, is set by the setting module 60 according to the requirement of the smokers or the classification of tobacco tar, which makes a more humanized atomization effect and an improved user experience possible during tobacco tar atomization process. Different smoke effects can be obtained via setting different constant powers in accordance with corresponding electronic cigarettes. The first preset time T0 is either a fixed value or a variable value which can be adjusted according to the current battery voltage value. It is possible to integrate setting module 60 into microcontroller 50 in the concrete implementation.

In the embodiments mentioned above, the semiconductor switch 30 for heating control of the heating element may be one of a triode, a field-effect tube, and an insulated gate bipolar transistor.

While the present invention has been described with reference to preferred embodiments, however, the present invention is not limited to above-mentioned embodiments, those modifications, improvements and equivalent substitutions, which don't depart from the scope of the spirit and the principle of the present invention, should be included within the scope of the present invention.

The invention claimed is:

1. A method for heating control of an electronic cigarette, used to a device for heating control of an electronic cigarette, the device comprising a heating element, a power battery, a semiconductor switch, a smoke signal detecting module, a setting module, and a microcontroller connected with the setting module, the power battery, the smoke signal detecting module and a control end of the semiconductor switch, wherein the microcontroller comprises a timer, a sampling unit, a calculating unit, a control unit and a resetting unit;

wherein the method comprising steps as follows:

S0. setting a first preset time T0 and a preset constant power by the setting module;

S1. detecting whether there is a smoke signal from a sensor or a switch, if yes, executing step S2;

S2. activating the timer to record time and turning on the semiconductor switch so as to heat the heating element in a full output power mode;

S3. heating the heating element in a constant power mode when the recording time of the timer arrives at the first preset time T0, a count value of the timer will be reset when the microcontroller turns on the semiconductor switch to heat the heating element with a constant power;

wherein the step S3 further comprises:

S31. sampling voltage of a power battery by the sampling unit;

S32. calculating a duty ratio of a pulse width modulation signal in accordance with the voltage of the power battery and the preset constant power by the calculating unit, the preset constant power $P=U^2/R*K$, U is battery voltage, R is resistor of the heating element, K is value of coefficient;

S33. controlling breakover of the semiconductor switch based on the calculated pulse width modulation signal, and implementing heating control of the heating element in the constant power mode by the control unit;

wherein it further comprises the following step after the step S3:

S4. resetting the count value of the timer by the resetting unit;

wherein the semiconductor switch is one of a triode, a field-effect transistor and an insulated gate bipolar transistor, one end of the semiconductor switch is directly connected to the microcontroller, other end of the semiconductor switch is directly connected to the heating element.

2. A device for heating control of an electronic cigarette, comprising a heating element, a power battery used for powering the electronic cigarette, a semiconductor switch used for controlling the power battery to heat the heating element or not, a smoke signal detecting module used for detecting whether there is a smoke signal, a setting module used for setting a first preset time T0 and a preset constant power, and a microcontroller connected with the setting module, the power battery, the smoke signal detecting module and a control end of the semiconductor switch simultaneously;

wherein the microcontroller comprises a timer, the microcontroller will give orders to turn on the semiconductor switch and activate the timer to record time when a smoke signal has been detected by the smoke signal detecting module, the heating element is heated in a full power output mode; the heating element is heated in a constant power control mode when a count value of the timer arrives at the first preset time T0; the count value of the timer will be reset when the microcontroller turns on the semiconductor switch to heat the heating element with a constant power;

wherein the microcontroller further comprises:

a sampling unit, which is used for sampling voltage of the power battery;

a calculating unit, which is connected to the sampling unit and used for calculating a duty ratio of a pulse width modulation signal according to the voltage of the power battery and the preset constant power, the preset constant power $P=U^2/R*K$, U is battery voltage, R is resistor of the heating element, K is value of coefficient;

a control unit, which is connected to the calculating unit and used for controlling breakover of the semiconductor switch based on the calculated pulse width modulation signal, and implementing heating control of the heating element;

wherein the microcontroller further comprises:

a resetting unit, which is connected to the timer and used for resetting the count value of the timer; and wherein the semiconductor switch is one of a triode, a field-effect transistor and an insulated gate bipolar transistor, one end of the semiconductor switch is directly connected to the microcontroller, other end of the semiconductor switch is directly connected to the heating element.

* * * * *